United States Patent [19]

Thomsen

[11] Patent Number: 5,000,350

[45] Date of Patent: Mar. 19, 1991

[54] DISPENSER WITH REPLACEABLE POUCH

[76] Inventor: Peter N. Thomsen, 100 N. Hill Dr., No. 28, Brisbane, Calif. 94005

[21] Appl. No.: 452,229

[22] Filed: Dec. 18, 1989

Related U.S. Application Data

[63] Continuation-in-part of Ser. No. 807,293, Dec. 11, 1985.

[51] Int. Cl.[5] ..... B65D 35/28; B65D 35/08; B65D 37/00

[52] U.S. Cl. ..... 222/103; 222/95; 222/491

[58] Field of Search ..... 222/214, 325, 181, 409, 222/95, 96, 103, 541, 530, 538

[56] References Cited

U.S. PATENT DOCUMENTS

| | | | |
|---|---|---|---|
| 3,009,498 | 11/1961 | Fohr | 222/527 |
| 3,184,121 | 5/1965 | Volckening | 222/541 |
| 3,255,932 | 6/1966 | Hunter et al. | 222/105 |
| 3,815,794 | 6/1974 | Carlisle | 222/530 |
| 3,878,977 | 4/1975 | Carlisle | 222/530 |
| 4,124,049 | 11/1978 | Yamaguchi | 222/530 |
| 4,163,509 | 8/1979 | Amneus | 222/105 |
| 4,252,257 | 2/1981 | Herzig | 222/491 |
| 4,312,689 | 1/1982 | Amneus | 156/160 |
| 4,634,022 | 1/1987 | O'Halloran et al. | 222/95 |
| 4,690,307 | 9/1987 | Hogan | 222/181 |

FOREIGN PATENT DOCUMENTS

| | | | |
|---|---|---|---|
| 735289 | 5/1966 | Canada | 222/90 |

*Primary Examiner*—Andres Kashnikow
*Assistant Examiner*—Lesley D. Morris
*Attorney, Agent, or Firm*—Phillips, Moore, Lempio & Finley

[57] ABSTRACT

A pair of superimposed panels are heat sealed together to define a reservoir in a dispenser pouch, adapted to contain a liquid therein. A spout is formed in offset relationship on a lower end of the pouch and defines a charging chamber that communicates with the reservoir to retain a pre-measured charge of the liquid therein. The spout terminates at a normally closed valve that opens when a predetermined external and downward pumping pressure is applied to the spout. A retention band may be secured transversely across on outer side of one of the panels to retain the spout when it is reverse-bent and slipped thereunder. The pouch is adapted for mounting in a dispensing unit having a dual-action pressure plate for pumping and dispensing the pre-measured charge of liquid from the spout.

22 Claims, 3 Drawing Sheets

DISPENSER WITH REPLACEABLE POUCH

This application is a continuation-in-part of U.S. patent application Ser. No. 06/807,293, filed on Dec. 11, 1985 by applicant for "Dispenser Pouch and Method for Forming the Same."

TECHNICAL FIELD

This invention relates generally to a dispenser pouch adapted to contain a liquid therein and more particularly to a sealed pouch mounted in a dispensing unit and having a valve that is openable to dispense a pre-measured charge of liquid therefrom when an external downward pumping pressure is applied to a spout of the pouch.

BACKGROUND OF THE INVENTION

Dispensers for liquids having relatively high viscosities, such as soaps, shampoos, tomato ketchup, mayonnaise or the like, normally take the form of a semi-rigid plastic container having an openable closure cap or a reciprocal dispensing valve mounted thereon. Conventional dispensers of this type are relatively expensive to manufacture, prone to malfunction and normally do not insure that a pre-measured charge of the liquid will be dispensed therefrom.

Other types of conventional dispensers include thin-walled plastic pouches that are heat sealed to retain a liquid product therein. A corner of the pouch is either ripped open to dispense the product or a closure plug is used for this purpose. Further, U.S. Pat. Nos. 3,009,498; 3,184,121; and 3,815,794 and Canadian Patent No. 735,289 disclose pouches or bags which provide various types of closures to seal the bags after product has been dispensed therefrom. Bags of this type are prone to leakage and require mechanical manipulation or other extraneous forces to open and close the valves thereof.

DISCLOSURE OF INVENTION

An object of this invention is to provide modified forms of the improved and leak-proof dispenser pouch and combined holder and dispenser, disclosed in my U.S. patent application Ser. No. 06/807,293, that are economical to manufacture and will repeatedly dispense pre-measured charges of liquid in a controlled and efficient manner.

The dispenser pouch comprises a pair of panels defining a reservoir adapted to contain a liquid therein and a spout formed on a lower end of the pouch (the pump area) for retaining a pre-measured charge of the liquid prior to dispensing thereof. A normally closed valve is defined at a lower end of the spout for opening to dispense the pre-measured charge of liquid in response to application of a descending pumping pressure on the spout.

In one aspect of this invention, the spout is disposed in transverse, offset relationship relative to a central longitudinal axis of the pouch.

In another aspect of this invention, a strap is formed transversely across an outer side of the pouch to receive the spout in reverse-bent, stored relationship thereunder.

In another aspect of this invention, the pouch is adapted for mounting in a dispensing unit of the general type described in my U.S. patent application Ser. No. 06/807,293. The modified dispensing unit, disclosed and claimed herein, includes an upper cover portion and a contiguous lower cover portion or press plate pivotally mounted on a lower end of the dispensing unit. A pressure plate is pivotally mounted on the press plate and is responsive to a pushing-down of the press plate to dispense the pre-measured quantity of liquid from the spout of the pouch.

BRIEF DESCRIPTION OF THE DRAWINGS

Other object and advantages of this invention will become apparent from the following description and accompanying drawings wherein.

BEST MODE OF CARRYING OUT THE INVENTION

Figure 1:
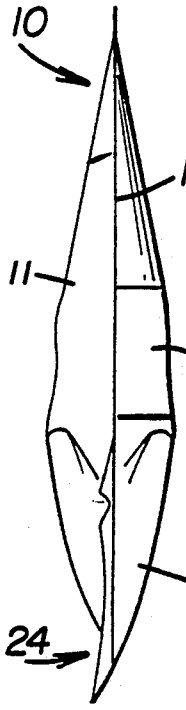
FIG. 1 is a side elevational view of a dispenser pouch embodying this invention.
Figure 2:
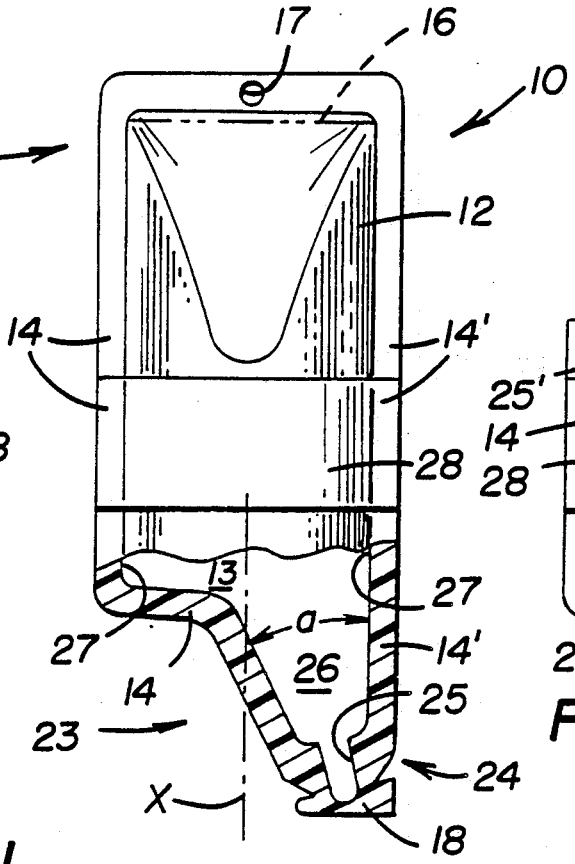
FIG. 2 is a partially sectioned front elevational view of the dispenser pouch.

FIGS. 1 and 2 illustrate a dispensing pouch 10 comprising a pair of superimposed front and rear panels 11 and 12, respectively. Common numerals depict corresponding components and constructions corresponding to like-numbered ones disclosed in my U.S. patent application Ser. No. 06/807,293. The pouch defines a reservoir 13 adapted to contain a liquid product therein, such as soap, shampoo, tomato ketchup, mayonnaise or other suitable product in liquid form. The viscosity of the liquid product may range from that of water (1 centipoise) to that of a highly viscous liquid in the range of 1,000 centipoises.

In the preferred embodiment of this invention, panels 11 and 12 constitute a pair of separate composite plastic sheets superimposed over each other during manufacture and heat-sealed together substantially about their peripheries, as depicted at side seams 14 and 14', for example. An upper end 15 of the dispenser pouch is preferably left open during initial stages of the packaging process to fill the pouch with a liquid product to a level 16, shown in FIG. 2. After filling, the overlying panel portions at the upper end of the pouch are also heat-sealed together, as shown.

Figure 3:
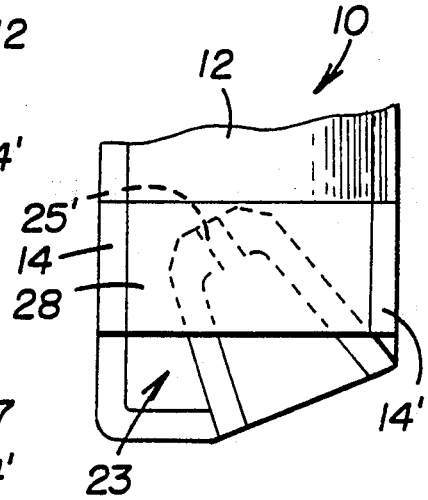
FIG. 3 is a partial front elevational view of the pouch, showing a retention strap for retaining a spout and valve of the pouch in reverse-bent relationship thereunder.

One or more holes 17 an be formed through the upper seam of the pouch to adapt it for mounting purposes, as described more fully hereinafter. A lower end of the pouch is preferably closed during manufacture by sealed panel portions forming a removable closure portion 18. The closure portion can be snipped-off by scissors, for example, when the dispenser pouch is placed in use by a consumer (FIG. 3).

Each panel 11 and 12 is preferably composed of a co-extruded composite plastic material of the types described in my afore-mentioned application. Individual thickness and compositions of the panels will vary depending on the particular consumer product application under consideration. The composite thickness of each panel 11 and 12 is preferably selected from the approximate range of from 3.0 mils to 10.0 mils for most pouch applications of the home product type, adapted to contain from 50 ml to 5,000 ml of a liquid product in reservoir 13. Further, it is contemplated that most dispenser pouches of this type would have a total length in the approximate range from 10.0 cm to 36.0 cm and an internal maximum width of reservoir 13 (between seams 14 and 14' in FIG. 2) of from 5.0 cm to 12.0 cm.

Referring to FIG. 2, dispenser pouch 10 further comprises a downwardly tapered neck or spout 23 terminating at its lower end at a valve 24, including a normally closed passage 25. The passage is rectangular and straight and is normally flattened and entirely compressed together and closed throughout its length. Spout 23 defines a charging chamber 26 therein communicating at its upper end with reservoir 13 to receive and retain a pre-measured charge of liquid 16 therein.

When the pouch is filled, valve 24 (after removal of closure portion 18) will normally close passage 25 due to a "crimping" and entire compressing together of overlying and unattached portions of panels 11 and 12 defining the straight and uninterrupted valve and passage. When a descending pumping pressure is applied externally on spout 23 and charging chamber 26, i.e., by applying descending finger pressure thereto, valve 24 will open to dispense the pre-measured charge of liquid from charging chamber 26 and through passage 25. As described more fully hereinafter, dispensing unit 29 of FIGS. 6–10 simulates such a dispensing function when operated.

As further shown in FIG. 2, inner sides 27 of the pouch, in part defining reservoir 13, terminate at the upper extremity of spout 23. Spout 23 and its charging chamber 26 are defined, in part, by such inner sides that preferably taper downwardly in converging relationship relative to each other. The spout is disposed in transverse offset relationship relative to a central longitudinal axis X of the pouch.

A first side seam 14, defining one side of reservoir 13 and spout 23, is offset inwardly towards axis X at a juncture of a bottom of the reservoir with a top of charging chamber 26. Second side seam 14' is straight and parallel relative to axis X. Acute angle "a," defining the tapered spout and charging chamber, is preferably selected from the approximate range of from 17° to 32°.

As shown in FIG. 3, a retention means 28 is preferable formed on one side of pouch 10 for retaining spout 23 in reverse-bent relationship thereon. In the illustrated embodiment, the retention means comprises a strap secured transversely across an outer side of panel 12, at seams 14, 14', for receiving the spout and valve 24 in slip-fit, stored relationship thereunder. The strap may be composed of the same plastic material comprising the panels of the pouch and heat-sealed thereto at seams 14, 14', during manufacture.

Figure 4:
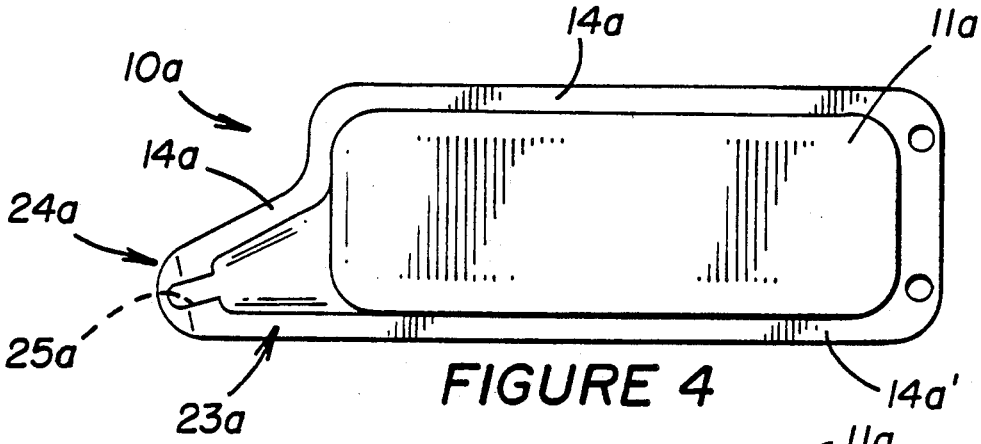
FIGS. 4 and 5 are top plan and side elevational views of a modified pouch, respectively.
Figure 5:
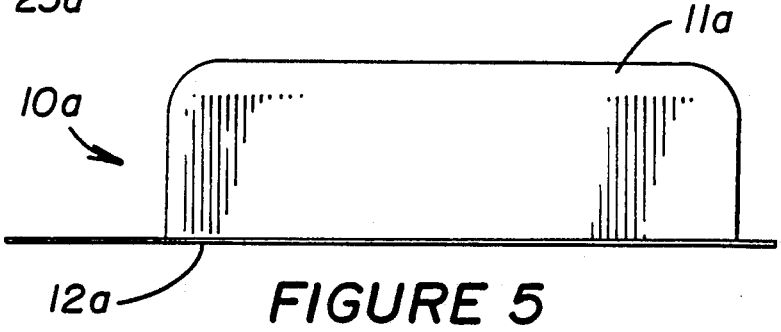
Figure 7:
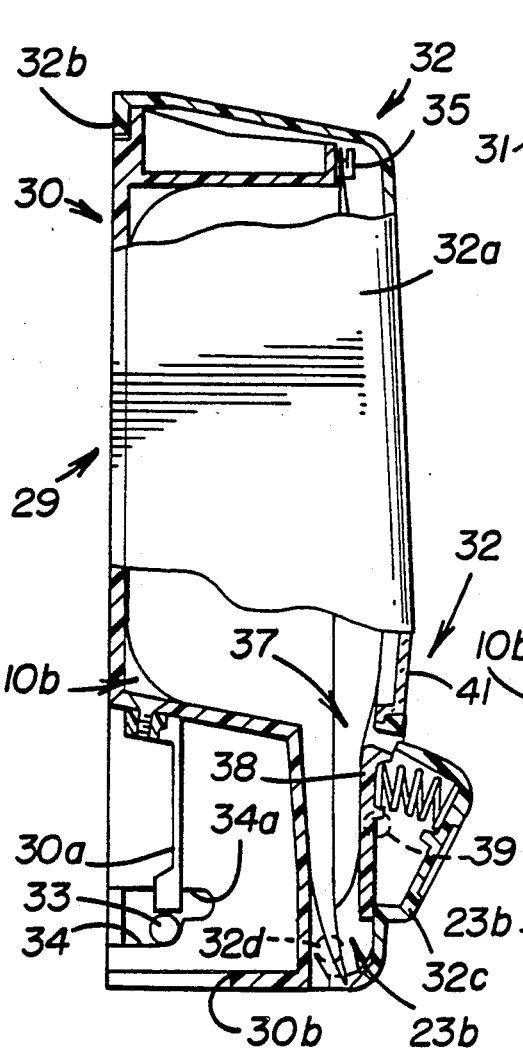
FIGS. 6 and 7 are partially sectioned front and side elevational views of a dispensing unit, showing a pouch mounted therein.
Figure 6:
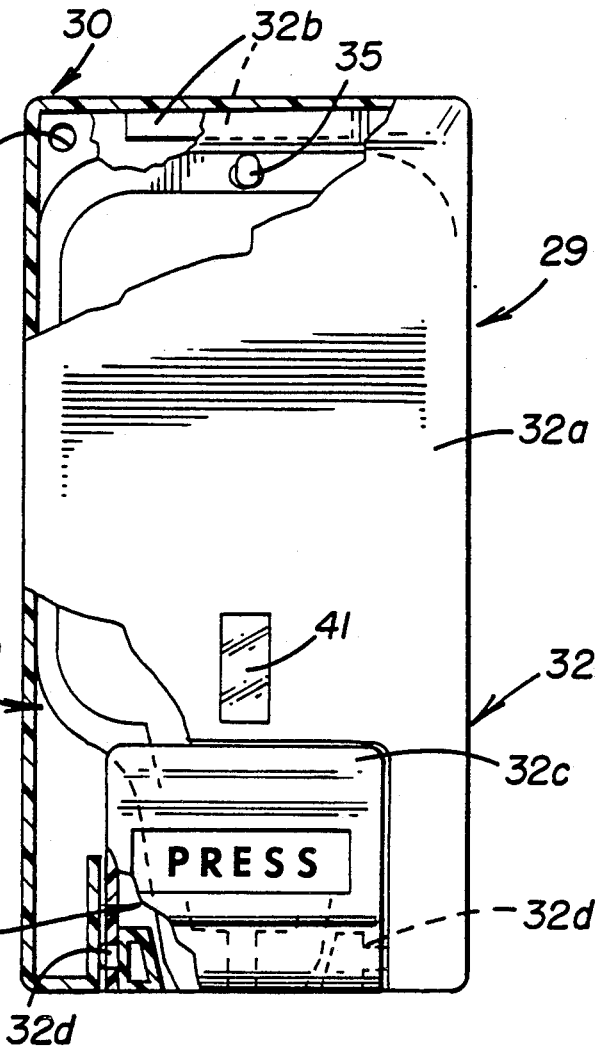

FIGS. 4 and 5 illustrate a modified dispenser pouch **10*a* wherein identical numerals (accompanied by a subscript "a") depict corresponding components and constructions. The pouch is "deep-drawn" during the molding process to provide an expanded first panel 11*a*, defining the reservoir therein, and a planar second panel 12*a*. Thus, whereas panels 11 and 12 of pouch 10 will expand outwardly on both sides of the pouch, when filled, panel 11*a* of pouch 10*a*** is "pre-expanded" to substantially assume its same shape and capacity, both before and after filling.

As suggested above, dispenser pouches 10 and **10*a* are particularly adapted for dispensing liquid soap, shampoo and cosmetic products in liquid from, having viscosities in the range of from 1 centipoise to 1,000 centipoise. In use, pouch 10 or 10*a* can be: (1) Held by hand to dispense a liquid product therefrom, such as a dishwashing detergent or the like, (2) Hung from wall hooks by use of one or more mounting holes or hung from a shower rod or the like by a hook (not shown) to allow dispensing of the product by a single hand, or (3) Mounted in the type of combined holder and dispensing unit 29 illustrated in FIGS. 6–10**. The dispensing unit adapts the pouch for mechanically induced dispensing pressure in a manner described in my aforementioned application.

Narrow passages 25 and **25*a* of pouches 10 and 10*a* held in closed positions to form respective valve 24 and 24*a* primarily due to the gravitational weight of the liquid product contained in reservoir 13 and communicated into charging chamber 26 (FIG. 1). In particular, the weight of the product and the resulting outward pressure imposed on overlying panels 11 and 12 in the area of spout 23, for example, will tend to slightly stretch or flatten and compress the superimposed panel portions defining passage 25 together to thus form normally closed valve 24. controlled product flow from chamber 26 through passage 25 will occur when the pressure applied to the spout is greater than the pressure imposed on the spout to maintain the passage and valve closed, e.g., when a continuous and descending pumping pressure approximating 15.0 psi is imposed on the spout in the manner sequentially illustrated in FIGS. 7–9**.

Combined holder and dispensing unit 29 comprises a mounting bracket 30 adapted to be secured on a wall or the like by a standard adhesive or by suitable fastening means inserted through holes 31 (one shown in FIG. 6) formed through the back panel of the bracket. A first cover portion **32*a* of a two-part cover 32 is pivotally mounted on a lower end of the mounting bracket by a pair of transversely disposed pins 33, mounted in slots 34. A flange 32*b* is formed centrally on an upper edge of cover portion 32*a* to normally hold it in a fixed position on the mounting bracket, along with a cantilevered leaf spring 30*a* that normally overlies each pin 33**.

A finger hole **30*b* is formed through a bottom wall of the mounting bracket to release spring 30*a* from pin 33 whereby the cover portion 32*a* can be lifted to release flange 32*b*, moved forwardly and upwardly into a slot portion 34*a*, and then pivoted outwardly and downwardly on pins 33 to expose a pouch 10*b*. A mounting pin 35 is secured on the frontal side of mounting bracket 30 to removably mount pouch 10*b*** thereon. If so desired, a pair of laterally spaced pins and accommodating holes can be used for this purpose.

Cover 32 further comprises a second cover portion or press plate **32*c*, pivotally mounted by pins 32*d* on bracket 30. When press plate 32*c* is pushed down, towards mounting bracket 30 for dispensing purposes as sequentially shown in FIGS. 7–9, a compressing means 37 will function to compress and apply a descending pumping pressure on spout 23*b* to open the valve to dispense a pre-measured charge of liquid product from pouch 10*b*. The compression means comprises a cam member or pressure plate 38, pivotally mounted by a pair of pins 39 on an inner side of press plate 32*c*. An upper end of the pressure plate is normally spring-biased into relatively "light" and non-dispensing contact with the pouch by a compression coil spring 40**.

Figure 8:
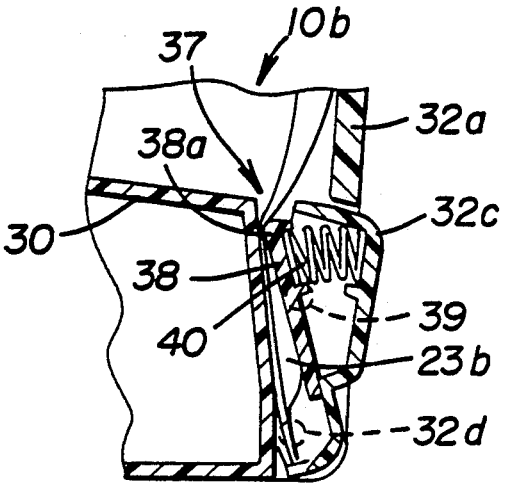
FIGS. 8 and 9 are sectioned side elevational views showing the sequential application a descending pumping pressure by the dispenser on a spout of the pouch.
Figure 9:
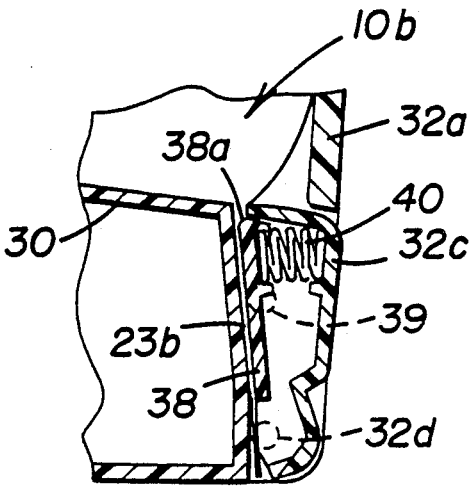
Figure 10:
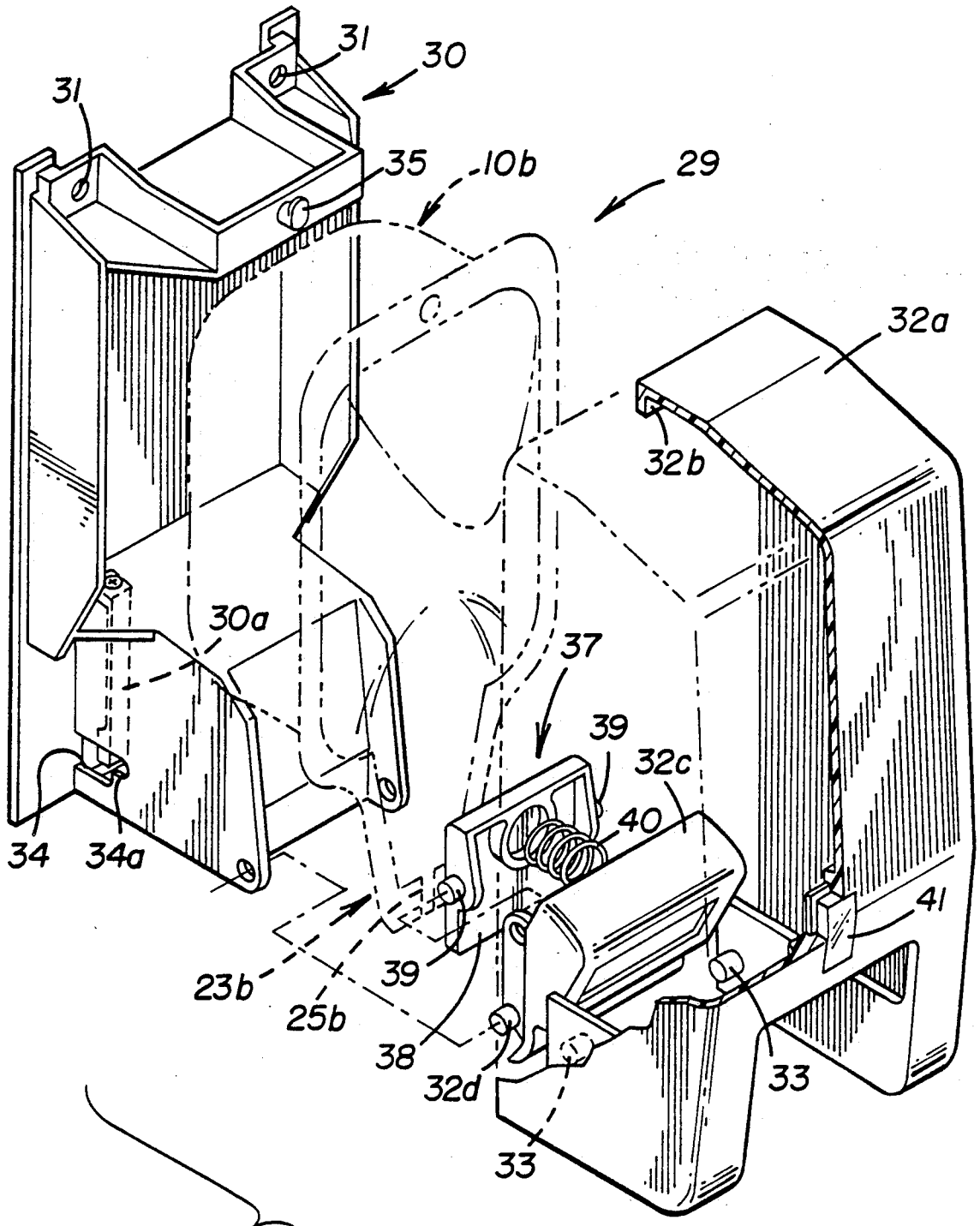
FIG. 10 is an exploded isometric view of the dispensing unit.

As shown in FIG. 8, application of hand or finger pressure to press plate 32*c* will pivot the press plate on pins 32*d* and move an upper edge 38*a* of pressure plate 38 into line contact with the upper end of spout 23 to block further entry of liquid into its charging chamber. The motion of the cam member generally mimics the application of descending finger pressure to the spout for dispensing purposes. As shown in FIG. 9, continued application of pressure to press plate 32*c* will function to pivot pressure plate 38 about edge 38*a* to completely exhaust the charging chamber, defined in spout 23*b*. Upon release of the press plate, spring 40 will return the press and pressure plates to their FIG. 7 normal positions. The charging chamber in the spout will then fill automatically under the influence of gravity to ready the unit for a subsequent dispensing function. A sight window 41 can be mounted centrally in cover portion 32*a* to visually indicate the quantity of liquid remaining in pouch 10*b*.

I claim:

1. A dispenser pouch disposed on a central, longitudinal axis thereof comprising a pair of panels, only one of said panels being pre-expanded to define a reservoir adapted to contain a liquid therein, spout means defining a charging chamber on a lower end of said pouch communicating with said reservoir for retaining a pre-measured charge of said liquid therein, and normally closed valve means at a lower end of said spout means, including a passage solely defined by and between said panels, for opening to dispense said charge of liquid from said charging chamber in response to the application of a descending pumping pressure on said spout means.

2. The dispenser pouch of claim 1 wherein said panels comprise a pair of separate plastic sheets heat-sealed together about peripheral portions thereof, except for remaining unsealed at said passage, said peripheral portions including first and second side seams defining sides of said reservoir and said spout means.

3. The dispenser pouch of claim 2 wherein said panels are heat sealed together adjacent to an outlet of said valve means and passage, at a lower end of said dispenser pouch, to form a removable closure portion adapted to be snipped-off to open said passage.

4. The dispenser pouch of claim 2 wherein said first side seam is offset inwardly towards said axis at a juncture of a bottom of said reservoir with a top of said charging chamber and said second side seam is straight and parallel relative to said axis.

5. The dispenser pouch of claim 4 wherein a portion of said first side seam, defining an outer side of said spout means, converges inwardly towards said second side seam at an acute angle.

6. The dispenser pouch of claim 5 wherein said acute angle is selected from the approximate range of from 17° to 32°.

7. The dispenser pouch of claim 1 wherein said spout means comprises a downwardly tapered spout defined in part by first and second sides thereof that taper downwardly in converging relationship relative to each other with only said first side defining an acute angle relative to said axis.

8. The dispenser pouch of claim 7 wherein the second side of spout is parallel relative to said axis.

9. The dispenser pouch 1 further comprising retention means on said pouch for retaining said spout means in reverse-bent relationship thereon.

10. The dispenser pouch of claim 9 wherein said retention means comprises strap means secured transversely across on an outer side of one of said panels for retaining said reverse-bent spout means thereunder.

11. The dispenser pouch of claim 1 wherein said panels and said reservoir are expandable on both upper and lower sides thereof.

12. The dispenser pouch of claim 1 wherein only said one of said panels is expanded on only an upper side of said pouch and wherein the other panel is flat.

13. The dispenser pouch of claim 1 further comprising a dispensing unit including a mounting bracket having said dispenser pouch mounted thereon, a cover mounted on said mounting bracket to cover said dispenser pouch, and dispensing means for engaging and applying a downward pumping pressure on said spout means to selectively dispense said pre-measured charge of liquid therefrom.

14. The dispenser pouch of claim 13 wherein said dispensing means comprises a pivotally mounted press plate forming a bottom portion of said cover covering the spout of said dispenser pouch and pressure plate means pivotally mounted on said press plate for engaging and compressing said spout in response to pivoting of said press plate.

15. A dispenser pouch comprising overlying first and second panels sealed together about peripheral portions thereof to define a reservoir adapted to contain a liquid therein, a spout defining a charging chamber on a lower end of said pouch communicating with said reservoir, and normally closed valve means on a lower end of said spout means for dispensing liquid from said charging chamber in response to the application of a downward pumping pressure on said spout means, said first panel being planar and said second panel being expanded to define said reservoir therein.

16. The dispenser pouch of claim 15 further including retention means comprising strap means secured transversely across an outer side of one of said panels for retaining said spout means in reverse-bent and stored relationship thereunder.

17. A dispensing unit for retaining a dispenser pouch having a reservoir adapted to contain a liquid therein, a spout defining a charging chamber on a lower end of said pouch communicating with said reservoir for retaining a pre-measured charge of said liquid therein, and a normally closed valve at a lower end of said spout for opening to dispense said pre-measured charge of liquid from said charging chamber in response to the application of a descending pumping pressure on said spout means, said dispensing unit comprising bracket means for mounting said dispenser pouch thereon to position said spout adjacent to a lower end thereof, a cover comprising an upper cover portion mounted on said bracket and a contiguous lower cover portion pivotally mounted on a lower end of said dispensing unit, and pressure plate means pivotally mounted on said lower cover portion for engaging and compressing said spout means with a descending pumping pressure to dispense said pre-measured charge of liquid from said charging chamber in response to pivoting of said lower cover portion.

18. The dispensing unit of claim 17 wherein said lower cover portion comprises a press plate and spring means mounted between said press plate and said pressure plate means for normally biasing upper portions thereof away from each other.

19. The dispensing unit of claim 17 further comprising window means on the upper cover portion of said cover, positioned adjacent to the lower cover portion thereof, for visually noting the remaining contents of said dispenser pouch when said dispenser pouch is mounted in said dispensing unit.

20. A dispenser pouch disposed on a central, longitudinal axis thereof comprising a pair of panels defining a reservoir adapted to contain a liquid therein, spout means disposed in transverse, offset relationship relative to said axis and defining a charging chamber on a lower end of said pouch communicating with said reservoir for retaining a pre-measured charge of said liquid therein, and normally closed valve means at a lower end of said spout means, including a passage solely defined by and between said panels, for opening to dispense said charge of liquid from said charging chamber in response to the application of a descending pumping pressure on said spout means, said panels comprising a pair of separate plastic sheets heat-sealed together about peripheral portions thereof, except for remaining unsealed at said passage, said peripheral portions including first and second side seams defining sides of said reservoir and said spout means, said first side seam being offset inwardly towards said axis at juncture of a bottom of said reservoir with a top of said charging chamber and said second side seam being straight and parallel relative to said axis.

21. A dispenser pouch disposed on a central, longitudinal axis thereof comprising a pair of panels defining a reservoir adapted to contain a liquid therein, spout means disposed in transverse, offset relationship relative to said axis and defining a charging chamber on a lower end of said pouch communicating with said reservoir for retaining a pre-measured charge of said liquid therein, said spout means comprising a downwardly tapered spout defined in part by first and second sides thereof that taper downwardly in converging relationship relative to each other with only said first side defining an acute angle relative to said axis, and normally closed valve means at a lower end of said spout means, including a passage solely defined by and between said panels, for opening to dispense said charge of liquid from said charging chamber in response to the application of a descending pumping pressure on said spout means.

22. A dispenser pouch disposed on a central, longitudinal axis thereof comprising a pair of panels defining a reservoir adapted to contain a liquid therein, spout means disposed in transverse, offset relationship relative to said axis and defining a charging chamber on a lower end of said pouch communicating with said reservoir for retaining a pre-measured charge of said liquid therein, normally closed valve means at a lower end of said spout means, including a passage solely defined by and between said panels, for opening to dispense said charge of liquid from said charging chamber in response to the application of a descending pumping pressure on said spout means, and a dispensing unit including a mounting bracket having said dispenser pouch mounted thereon, a cover mounted on said mounting bracket to cover said dispenser pouch, and dispensing means for engaging and applying a downward pumping pressure on said spout means to selectively dispense said pre-measured charge of liquid therefrom, said dispensing means comprising a pivotally mounted press plate forming a bottom portion of said cover covering the spout of said dispenser pouch and pressure plate means pivotally mounted on said press plate for engaging and compressing said spout in response to pivoting of said press plate.

* * * * *